US009745874B2

(12) United States Patent
Hofer et al.

(10) Patent No.: US 9,745,874 B2
(45) Date of Patent: Aug. 29, 2017

(54) PISTON ASSEMBLY RETAINER WITH INTEGRATED SPRING SEAT

(71) Applicant: Schaeffler Technologies AG & Co. KG, Herzogenaurach (DE)

(72) Inventors: Béla Hofer, Troy, MI (US); Donald J. Dixon, Ortonville, MI (US); Kevin Sittner, West Bloomfield, MI (US); Todd Simcina, Huntington Woods, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 127 days.

(21) Appl. No.: 14/919,164

(22) Filed: Oct. 21, 2015

(65) Prior Publication Data

US 2017/0114679 A1 Apr. 27, 2017

(51) Int. Cl.

| | |
|---|---|
| ***F01L 9/02*** | (2006.01) |
| ***F01L 1/14*** | (2006.01) |
| *F01L 1/18* | (2006.01) |

(52) U.S. Cl.

CPC ..... *F01L 9/023* (2013.01); *F01L 1/146* (2013.01); *F01L 1/18* (2013.01)

(58) Field of Classification Search

CPC ..... F01L 1/18; F01L 1/146; F01L 9/023

USPC ..... 123/90.12, 90.39, 90.44, 90.45

See application file for complete search history.

(56) References Cited

U.S. PATENT DOCUMENTS

| | | | | |
|---|---|---|---|---|
| 1,976,520 | A | 10/1934 | Rockwell | |
| 2,178,444 | A | 10/1939 | Ware | |
| 4,596,213 | A | 6/1986 | Hillebrand | |
| 7,347,172 | B2 * | 3/2008 | Strickler | F01L 1/245 123/90.12 |
| 2013/0075211 | A1 | 3/2013 | Plantan et al. | |

OTHER PUBLICATIONS

Technology INA UniAir System, Schaeffer Automotive Aftermarket, Product Literature, pp. 6-7. 2011.

* cited by examiner

*Primary Examiner* — Ching Chang

(74) *Attorney, Agent, or Firm* — Volpe and Koenig, P.C.

(57) ABSTRACT

A piston assembly for pressurizing a hydraulic chamber is provided. The piston assembly has a cylinder and a piston configured to reciprocate within the cylinder. The piston has a first end in the cylinder and a second end adapted to be acted on by a drive element. The piston assembly also has a spring configured to bias the piston. The piston assembly further has a retainer mounted to an exterior of the cylinder and including a seat surface. The spring is seated on the seat surface. The outer diameter of the spring is less than the outer diameter of the cylinder.

14 Claims, 2 Drawing Sheets

PISTON ASSEMBLY RETAINER WITH INTEGRATED SPRING SEAT

FIELD OF INVENTION

The present invention relates to a piston assembly, and, more particularly, to a piston assembly retainer with an integrated spring seat.

BACKGROUND

Engines include a variety of components working together to produce power. Often these components must fit within small spaces in and around the engine to make efficient use of the space and to avoid interfering with each other. For example, cylinder heads often include many cavities and openings to accommodate a variety of components, such as valve train components. The size of these components may be limited to the available space. Therefore, compact designs may be preferable to ensure that space is efficiently utilized and interference between components is avoided.

Many such components in engines are assembly packages that include a plurality of sub-components. These assembly packages may include sizes corresponding to the largest dimension of a sub-component. For example, U.S. Pat. No. 2,178,444 discloses a valve dampening assembly that includes a diameter equal to an outer diameter of a spring, because the spring surrounds all of the other components of the assembly. Pump units of variable valve train systems similarly include a spring that surrounds all of the other components, thereby causing the pump unit to take up a relatively large amount of space within the engine.

The present disclosure is directed to overcoming one or more problems of the prior art, including providing a compact assembly package while promoting low cost manufacturing.

SUMMARY

In one aspect, the present disclosure is directed to a piston assembly for pressurizing a hydraulic chamber. The piston assembly includes a cylinder and a piston configured to reciprocate within the cylinder. The piston includes a first end in the cylinder and a second end adapted to be acted on by a drive element. The piston assembly further includes a spring configured to bias the piston and a retainer mounted to an exterior of the cylinder. The retainer includes a seat surface, and the spring is seated on the seat surface.

In another aspect, the present disclosure is directed to a valve train system for an engine. The valve train system includes a drive element, a hydraulic chamber, and a piston assembly configured to pressurize the hydraulic chamber. The piston assembly includes a cylinder including an outer diameter, and a piston configured to reciprocate within the cylinder. The piston includes a first end in the cylinder and a second end configured to be operatively connected to the drive element. The piston assembly further includes a retainer connected to an external portion of the cylinder and configured to retain a portion of the piston inside the cylinder. The piston assembly further includes a spring retainer attached to the second end of the piston and a spring held between the retainer and the spring retainer. The outer diameter of the cylinder is greater than an outer diameter of the spring.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
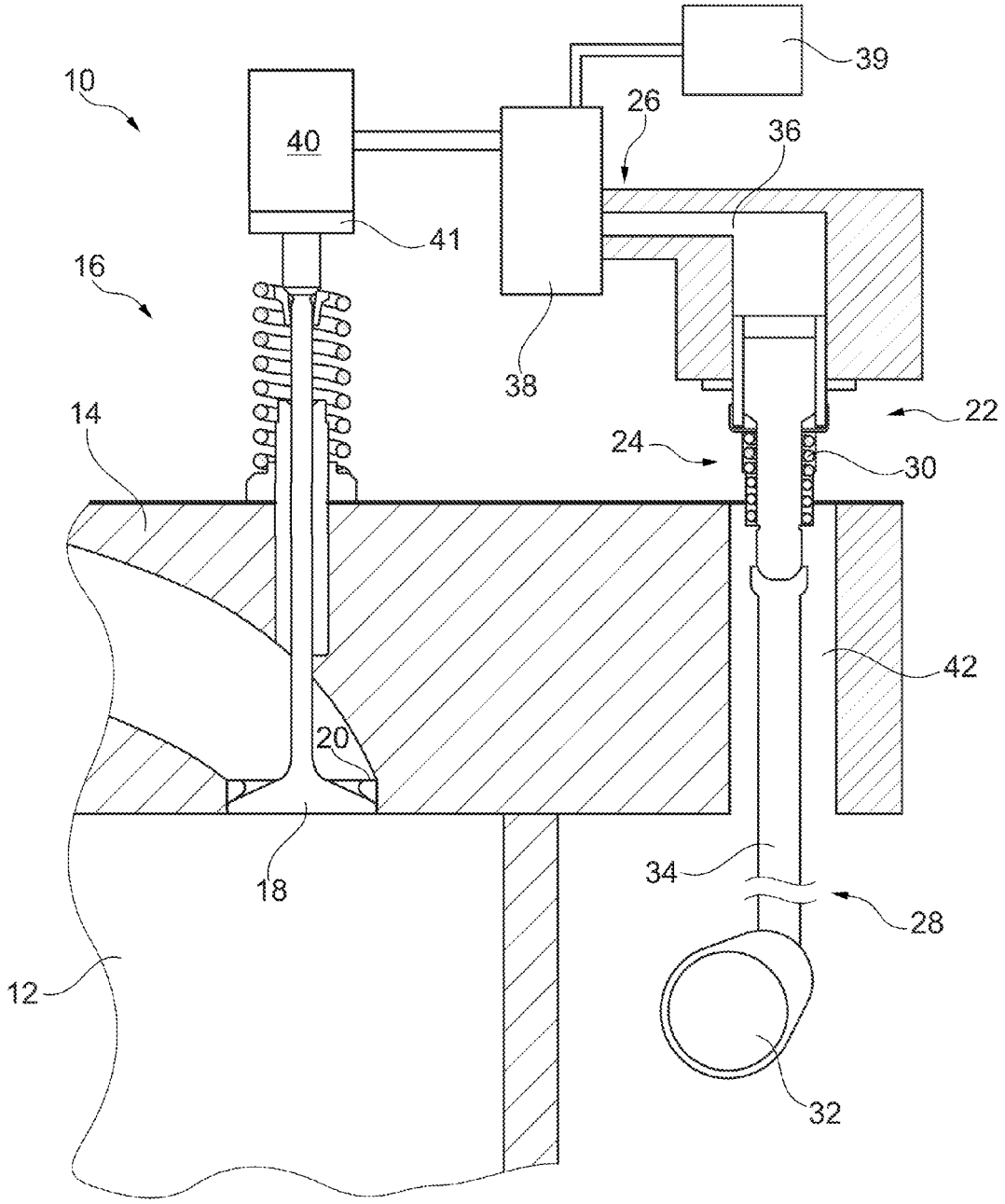
FIG. 1 shows a schematic illustration of an exemplary valve train system.

FIG. 1 shows a portion of an exemplary engine 10, including at least one cylinder 12 and cylinder head 14, according to a disclosed embodiment. The engine 10 may be any of several types of engines, including liquid and/or gaseous fueled internal combustion engines. It should be understood, however, that the engine 10 may be any type of engine that includes one or more of the components described herein. Further, the disclosed embodiments are not limited to use with engines, and could be implemented on other systems, such as other power, generator, and/or pump systems.

The engine 10 includes a valve train system 16 including at least one valve 18. In one embodiment, the valve 18 is a poppet valve configured to move between open and closed positions to thereby control flow of fluid through a corresponding opening, although other valve configurations are possible. For example, the valve 18 may be an intake valve configured to control the flow of air into the cylinder 12. The valve 18 rests against a valve seat 20 in a closed position, and moves away therefrom to allow air to flow through the corresponding opening.

The valve train system 16 further includes components configured to control the opening and closing of the valve 18. For example, the valve train system 16 includes a variable valve timing device 22. The variable valve timing device 22 includes, for example, a pump unit 24, a hydraulic control unit 26, and a drive element 28.

The pump unit 24 and the hydraulic control unit 26 operate in conjunction with each other to selectively open and/or close the valve 18. In one embodiment, the pump unit 24 includes a piston assembly 30. The piston assembly 30 is operatively connected to the drive element 28. For example, the piston assembly 30 is operatively connected to a cam 32 (e.g., of a camshaft of engine 10) through a pushrod 34. In other embodiments, the pump unit 24 may be directly connected to the cam 32 or connected through another component, such as a finger lever or cam follower. The hydraulic control unit 26 includes at least a hydraulic chamber 36, a control valve 38, a hydraulic accumulator 39, and an activated cylinder 40.

In one embodiment, the pump unit 24 pressurizes the hydraulic chamber 36 through movement transferred from the drive element 28. The control valve 38 may be, for example, an electronically-controlled solenoid valve. When the control valve 38 is closed, the pressurized hydraulic fluid from the piston assembly 30 acts as a hydraulically rigid pushrod that causes the valve 18 to move away from the valve seat 20 toward an open position (e.g., by overcoming a biasing force holding the valve 18 against the valve seat 20). When the control valve 38 is opened, hydraulic fluid displaced by the piston assembly 30 is directed to the hydraulic accumulator 39, thereby lowering the pressure in or depressurizing the path from the hydraulic chamber 36 to the activated cylinder 40. The depressurization causes the valve 18 to move toward the closed position (e.g., because the biasing force overcomes the lack of force from the hydraulic fluid). This disconnects the movement of the cam 32 from the valve 18.

The activated cylinder 40 controls the opening and closing movement of the valve 18. A brake unit 41 may also be provided to prevent quick movements of the valve 18 that may cause damage, depending on the biasing force of a valve spring and any hydraulic damping provided by the activated cylinder 40. The activation or deactivation as well as the timing of the opening and closing of the valve 18 is therefore controllable by the hydraulic control unit 26, such as through signals from an electronic controller or ECM (e.g., signals to a solenoid to open and close the control valve 38). It should be understood, however, that other embodiments of the variable valve timing device 22 are possible.

As shown in FIG. 1, at least some of the components of the variable valve timing device 22 are mounted to and/or positioned in the cylinder head 14. For example, the cylinder head 14 includes a cavity 42 configured to receive a component of the variable valve timing device 22, such as the pushrod 34. In an exemplary embodiment, at least a portion of the piston assembly 30 is installed in the cylinder head 14, such as by being positioned in the cavity 42. Because space in and around the cylinder head 14 is limited, the piston assembly 30 may include features that help to create a compact assembly.

Figure 2:
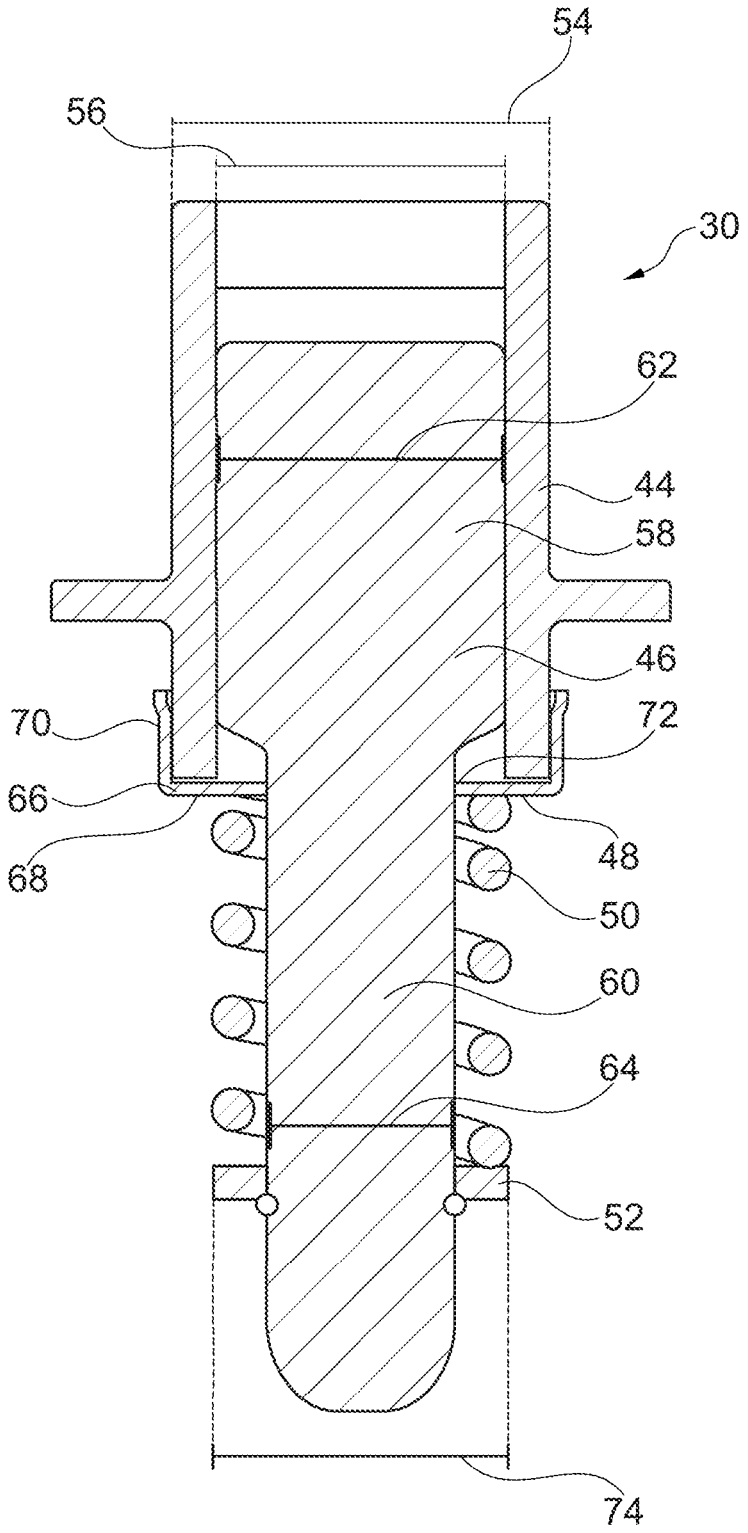
FIG. 2 depicts a piston assembly that may be used in conjunction with the valve train system of FIG. 1.

FIG. 2 further depicts an exemplary embodiment of the piston assembly 30. While the piston assembly 30 is described as being a component of the pump unit 24, it should be understood that the configuration of the piston assembly 30 may be applied to other components, shown or unshown. In an exemplary embodiment, the piston assembly 30 includes a cylinder 44, a piston 46, a retainer 48, a spring 50, and a spring retainer 52. The cylinder 44 may be a guide member defining a cylindrical space, although other shapes are possible. The cylinder 44 may be mounted to another component of the engine 10, such as a portion of the hydraulic control unit 26. For example, the cylinder 44 may include a threaded portion allowing the cylinder 44 to be torqued into hydraulic control unit 26. In some embodiments, the cylinder 44 may be torqued into a portion of the cylinder head 14 (e.g., a portion of the cylinder head 14 forming a housing of the hydraulic control unit 26). The cylinder 44 defines an outer diameter 54 and an inner diameter 56.

The piston 46 is configured to reciprocate in the cylinder 44. The piston 46 includes a first end 58 (e.g., first end portion) in the cylinder 44 and a second end 60 (e.g., second end portion) configured to be operatively connected to the drive element 28. In this way, reciprocating motion of the drive element 28 causes corresponding motion of the piston 46 within the cylinder 44. The first end 58 of the piston 46 includes a diameter 62 and the second end 60 of the piston 46 includes a smaller diameter 64.

In an exemplary embodiment, the retainer 48 is mounted to an exterior of the cylinder 44. The retainer 48 may be a cap 66 configured to help retain the piston 46 within the cylinder 44. The cap 66 includes a seat surface 68 and a flange 70. The seat surface 68 may be positioned on an end of the cylinder 44, such as to partially close an opening into the cylinder 44. The flange 70 surrounds and is secured to a portion of the cylinder 44. For example, the cap 66 may be press fit onto the end of the cylinder 44. It should be understood, however, that other attachment means are possible (e.g., welding, adhesive, etc.). In one embodiment, the cap 66 may be stamped steel.

The retainer 48 helps to retain the piston 46 within the cylinder 44. For example, the first end 58 is held in the cylinder 44 by the cap 66. The cap 66 includes an opening 72 formed in the seat surface 68. The opening 72 includes a diameter that is less than the diameter 62 of the first end 58 of the piston 46. In addition, the diameter 64 of the second end 60 may be less than the diameter of the opening 72 such that the second end 60 extends through the opening 72, while the first end 58 is held within cylinder 44. The retainer 48 thereby helps to hold the piston assembly 30 together.

The spring 50 is configured to bias the piston 46 in one direction. For example, the spring 50 may be configured to axially bias the second end 60 of the piston 46 away from the cylinder 44. The spring 50 is seated on the seat surface 68 and is held between the seat surface 68 and the spring retainer 52. The spring retainer 52 is attached to the second end 60 of the piston 46 (e.g., by a retaining washer), thus allowing a biasing force of the spring 50 to be transferred to the piston 46. During operation, the spring 50 helps to return the piston 46 to an initial position after displacement by drive element 28.

The spring 50 includes an outer diameter 74 that is less than the outer diameter 54 of the cylinder 44. In this way, the piston assembly 30 is more compact than other possible configurations, such as a configuration in which the spring 50 is positioned around an exterior of the cylinder 44. This compact configuration allows for efficient use of space in and around the cylinder head 14. For example, at least a portion of the spring 50 may be installed on the cylinder head 14 (e.g., positioned in the cavity 42). Because the spring 50 is positioned between the retainer 48 and the spring retainer 52, the space necessary to accommodate the spring 50 (and any other portion of the piston assembly 30) may be relatively small, thereby providing space for other components and helping to inhibit interference between components. The compact design also promotes low cost manufacturing, at least because the retainer 48 may serve many different purposes, such helping to hold the piston assembly 30 together and acting as a support surface for the spring 50.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A piston assembly for pressurizing a hydraulic chamber, the piston assembly comprising:

a cylinder;

a piston configured to reciprocate within the cylinder, the piston including a first end in the cylinder and a second end adapted to be acted on by a drive element;

a spring configured to bias the piston; and a retainer mounted to an exterior of the cylinder and including a seat surface, wherein the spring is seated on the seat surface.

2. The piston assembly of claim 1, further including a spring retainer attached to the second end of the piston, wherein the spring is held between the seat surface and the spring retainer.

3. The piston assembly of claim 1, wherein the retainer is a cap, and the cap includes the seat surface positioned on an end of the cylinder.

4. The piston assembly of claim 3, wherein the cap further includes a flange surrounding a portion of the cylinder.

5. The piston assembly of claim 3, wherein the cap includes an opening formed in the seat surface, and the piston extends through the opening.

6. The piston assembly of claim 5, wherein the opening includes a diameter that is less than a diameter of the cylinder.

7. The piston assembly of claim 5, wherein the first end of the piston includes a diameter that is greater than a diameter of the opening and the second end of the piston includes a diameter that is less than the diameter of the opening.

8. The piston assembly of claim 7, wherein the first end is held in the cylinder by the cap and the second end extends through the opening.

9. The piston assembly of claim 1, wherein an outer diameter of the spring is less than an outer diameter of the cylinder.

10. A valve train system for an engine, comprising:

a drive element;

a hydraulic chamber; and a piston assembly configured to pressurize the hydraulic chamber, the piston assembly including a cylinder including an outer diameter;

a piston configured to reciprocate within the cylinder, the piston including a first end in the cylinder and a second end configured to be operatively connected to the drive element;

a retainer connected to an external portion of the cylinder and configured to retain the first end of the piston inside the cylinder;

a spring retainer attached to the second end of the piston; and a spring held between the retainer and the spring retainer, the spring defining an outer diameter, wherein the outer diameter of the cylinder is greater than the outer diameter of the spring.

11. The valve train system of claim 10, wherein at least a portion of the piston assembly is installed in a cylinder head of an engine.

12. The valve train system of claim 11, wherein the at least a portion of the piston assembly includes at least a portion of the spring.

13. The valve train system of claim 10, further comprising a control valve configured to open to depressurize the hydraulic chamber by directing hydraulic fluid to a pressure accumulator.

14. The valve train system of claim 13, further comprising an activated cylinder connected to a valve.

* * * * *